US008604681B2

(12) United States Patent
Ready et al.

(10) Patent No.: US 8,604,681 B2
(45) Date of Patent: Dec. 10, 2013

(54) COLD CATHODES AND ION THRUSTERS AND METHODS OF MAKING AND USING SAME

(75) Inventors: William Judson Ready, Atlanta, GA (US); Mitchell L. R. Walker, II, Mableton, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 5 days.

(21) Appl. No.: 12/921,109

(22) PCT Filed: Mar. 5, 2009

(86) PCT No.: PCT/US2009/036204

§ 371 (c)(1), (2), (4) Date: Sep. 3, 2010

(87) PCT Pub. No.: WO2009/131754

PCT Pub. Date: Oct. 29, 2009

(65) Prior Publication Data

US 2011/0005191 A1 Jan. 13, 2011

Related U.S. Application Data

(60) Provisional application No. 61/033,977, filed on Mar. 5, 2008.

(51) Int. Cl.
*H01J 1/00* (2006.01)

(52) U.S. Cl.
USPC ..... 313/311; 313/495; 313/310

(58) Field of Classification Search
USPC ..... 313/414, 441–460, 495–497, 293–304, 313/306, 309–310, 346, 351, 355
See application file for complete search history.

(56) References Cited

U.S. PATENT DOCUMENTS

| | | | | |
|---|---|---|---|---|
| 6,339,281 | B2 * | 1/2002 | Lee et al. | 313/309 |
| 6,448,701 | B1 * | 9/2002 | Hsu | 313/309 |
| 6,522,061 | B1 * | 2/2003 | Lockwood | 313/495 |
| 7,785,907 | B2 * | 8/2010 | Zheng et al. | 438/20 |
| 7,816,851 | B2 * | 10/2010 | Yoo et al. | 313/495 |
| 2003/0030356 | A1 * | 2/2003 | Fran et al. | 313/310 |
| 2004/0069994 | A1 * | 4/2004 | Guillorn et al. | 257/79 |
| 2005/0225228 | A1 * | 10/2005 | Burden et al. | 313/495 |
| 2006/0066217 | A1 * | 3/2006 | Son | 313/497 |
| 2006/0214560 | A1 * | 9/2006 | Noguchi et al. | 313/498 |
| 2007/0040960 | A1 * | 2/2007 | Yoo et al. | 349/70 |
| 2010/0019653 | A1 * | 1/2010 | Jung | 313/496 |

* cited by examiner

*Primary Examiner* — Donald Raleigh
(74) *Attorney, Agent, or Firm* — Ryan A. Schneider, Esq.; Troutman Sanders LLP

(57) ABSTRACT

Described herein are improved ion thruster components and ion thrusters made from such components. Further described are methods of making and using the improved ion thruster components and ion thrusters made therefrom. An improved cathode includes an emitter formed from a plurality of vertically aligned carbon nanotubes. An ion thruster can include the improved cathode.

19 Claims, 5 Drawing Sheets

COLD CATHODES AND ION THRUSTERS AND METHODS OF MAKING AND USING SAME

CROSS-REFERENCE TO RELATED APPLICATIONS

This application is a United States National Stage Application of International Patent Application Serial Number PCT/US2009/036204, filed 30 Jan. 2008, and entitled "Carbon Fibers and Films and Methods of Making Same," which claimed the benefit of U.S. Provisional Patent Application Ser. No. 61/033,977, filed 5 Mar. 2008, which are incorporated herein by reference in their entireties as if fully set forth below.

STATEMENT REGARDING FEDERALLY SPONSORED RESEARCH

This invention was made with United States Government support under agreement number HR0011-07-C-0056 awarded by the United States Department of Defense. The United States Government has certain rights in this invention.

TECHNICAL FIELD

The various embodiments of the present invention relate generally to cold cathodes, and more particularly, to carbon nanotube-containing cold cathodes, and to methods of making and using such devices.

BACKGROUND

In order for a spacecraft or satellite to move on its own accord in free space, the spacecraft or satellite generally must carry some mass that it can accelerate in one direction so as to propel itself in an opposite direction. This mass, often termed the "reaction mass" or "propellant," can be accelerated using a variety of means, including high temperature, fluid dynamics, electrostatic or electromagnetic forces, and the like.

Ion thrusters comprise one category of low-power engines where an electrostatic or electromagnetic force is used to accelerate an ionized reaction mass. Examples of ion thrusters include Hall or Hall effect thrusters, electrostatic ion thrusters, field emission electric propulsion (FEEP) thrusters, and colloid thrusters. This type of electric propulsion engine generally functions by ionizing the atoms of the reaction mass and then providing a voltage gradient to accelerate the ions out from the spacecraft or satellite. If too many accelerated ions in the exhaust plume are left as ions (i.e., charged), then a net build-up of charge will occur. This excess charge will alter the local electric field, causing a slowdown of ions that are accelerated in that region. Thus, after being exhausted from the engine of the spacecraft or satellite, the ionized reaction mass is neutralized.

Ion thrusters use an electron source to neutralize the ionized reaction mass. Most ion thrusters employ thermionic hollow cathodes, which require a gas flow in order to emit electrons. This propellant does not contribute to the thrust of the engine, yet still must be carried by the spacecraft or satellite. In addition, hollow cathodes can require a heater element, which is an additional load on the spacecraft or satellite power system. Since most low-power electric propulsion engines have limited power capacities, any expenditure in power (e.g., additional propellant needed for the hollow cathode, heat for the hollow cathode, or the like) that does not directly generate thrust is a source of inefficiency.

Accordingly, there remains a need for improved electron sources for neutralizing exhaust plumes in low-power electric propulsion devices. It would be particularly advantageous if the improvements reduced or eliminated power and mass expenditures that do not directly generate thrust. Such improved electron sources would provide more efficient electric propulsion devices.

It is to the provision of such electron sources and the resulting electric propulsion devices that the various embodiments of the present inventions are directed.

BRIEF SUMMARY

The various embodiments of the present invention provide improved electron emission sources, improved electric propulsion devices made therefrom, and methods of making and using such components and devices.

A cathode, according to some embodiments of the present invention includes a conductive base layer and an insulating layer that is disposed on the conductive base layer and has a plurality of apertures therein. The conductive base layer can be formed from a metal, semi-metal, or semiconductor. In some cases, the conductive base layer is formed from an n-type semiconductor.

The cathode can further include a conductive gate layer that is disposed on the insulating layer and has a plurality of apertures therein. The plurality of apertures of the insulating layer and the plurality of apertures of the conductive gate layer can be substantially coaxial. At least a portion of a side wall and/or a bottom surface of a distal end of each aperture of the plurality of apertures of the conductive gate layer can be exposed to a surface of the conductive base layer. Each aperture of the plurality of apertures of the insulating layer can be tapered such that the aperture is larger at an end distal from the conductive base layer than at an end proximal to the conductive base layer.

The cathode can further include a plurality of emitters in electrical communication with the conductive base layer. Each emitter of the plurality of emitters can be disposed in an aperture of the insulating layer and can project toward the conductive gate layer. Each emitter of the plurality of emitters can include an array of vertically aligned carbon nanotubes. The vertically aligned carbon nanotubes of each emitter of the plurality of emitters can be disposed on a catalyst layer that is itself disposed on the conductive base layer. In some cases, the emitters have a different shape as the apertures of the insulating layer.

The height of the carbon nanotubes can be greater than the height of the gate layer. In such cases, the cathode can have an extrinsic gate layer disposed above, and not in contact with, the gate layer. The height of the carbon nanotubes can be uniform within a given plurality of vertically aligned nanotubes of an emitter.

The cathode can also include a substrate on which the conductive base layer is disposed for additional structural integrity of the cathode.

The cathode can also include a dynode layer disposed above, and not in contact with, the gate layer.

The cathode can exhibit a current density that is greater than about 50 milliAmperes per square centimeter.

An ion thruster, according to some embodiments of the present invention, can include at least an electrode. The electrode can include a conductive base layer and an insulating layer that is disposed on the conductive base layer and has a plurality of apertures therein. The electrode can also have a conductive gate layer that is disposed on the insulating layer and has a plurality of apertures therein. The plurality of apertures of the insulating layer and the plurality of apertures of the conductive gate layer can be substantially coaxial. At least a portion of a side wall and/or the bottom surface of the distal end of each aperture of the plurality of apertures of the conductive gate layer can be exposed to a surface of the conductive base layer. The electrode can also include a plurality of emitters in electrical communication with the conductive base layer. Each emitter of the plurality of emitters can be disposed in an aperture of the insulating layer and can project toward the conductive gate layer. Each emitter of the plurality of emitters can include an array of vertically aligned carbon nanotubes.

In some cases the ion thruster is a Hall effect thruster. As such, the electrode can be a cathode of the Hall effect thruster, a reaction mass neutralizer of the Hall effect thruster, or both. In other cases, the ion thruster is an electrostatic ion thruster. In these situations, the electrode can be a cathode of the electrostatic ion thruster or a reaction mass neutralizer of the electrostatic ion thruster. In still other cases, the ion thruster is a colloid thruster. The electrode can then be a reaction mass neutralizer of the colloid thruster. In yet other cases, the ion thruster is a field emission electric propulsion thruster. The electrode can then be a reaction mass neutralizer of the field emission electric propulsion thruster.

Other aspects and features of embodiments of the present invention will become apparent to those of ordinary skill in the art, upon reviewing the following detailed description in conjunction with the accompanying figures.

DETAILED DESCRIPTION

Figure 1:
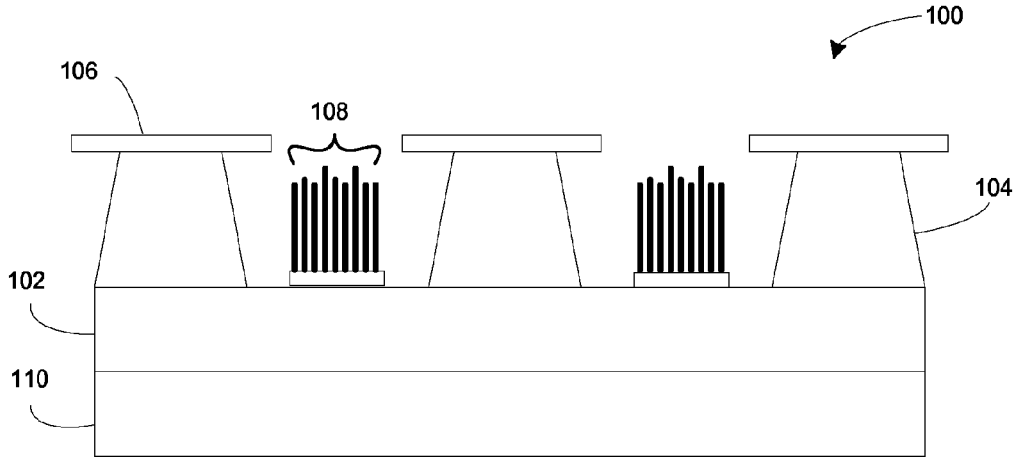
FIG. 1 is a schematic illustration of a carbon nanotube-containing cold cathode in accordance with some embodiments of the present invention.

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," "primary," "secondary," "top," "bottom," "distal," "proximal," and the like, do not denote any order, quantity, or importance, but rather are used to distinguish one element from another. Further, the terms "a", "an", and "the" do not denote a limitation of quantity, but rather denote the presence of "at least one" of the referenced item.

As stated above, the various embodiments of the present invention are directed to improved electric propulsion devices and components thereof. Specifically, improved cathodes (i.e., electron emission sources) are individually provided. Further, electric propulsion devices made from the improved cathodes are also provided. Their methods of manufacture and use are also described.

The improved cathodes described herein are so-called "field emission cathodes" and, specifically, can be classified as so-called "Spindt cathodes." Such cathodes are beneficial because they do not require a propellant or reaction mass to generate electrons. The improved cathodes described herein make use of a plurality of vertically aligned carbon nanotubes (CNTs) as the emitter.

As used herein, the term "aligned" encompasses items having at least a portion of a dimension (e.g., length, width, height, or the like) being either parallel to each other or within about 15 degrees of being parallel to one another if projected infinitely into space. Thus, two CNTs that do not directly contact each other, but would contact each other if the CNTs were infinitely long, and the angle formed between them is less than or equal to about 15 degrees, are considered aligned for the purposes of this disclosure. When a number of items are described herein as being aligned, then at least 70 percent of the items are aligned with one another. Thus, in referring to a plurality of CNTs being vertically aligned, it is intended that at least a portion of the length (i.e., the axis perpendicular to the diameter of the CNT) of at least 70 percent of the CNTs in the plurality are aligned. For example, when a plurality of vertically aligned CNTs are not linear and/or bundle together to form so-called "ropes," then a portion of the lengths (or the entire lengths) of at least 70 percent of the CNTs are either parallel or within about 15 degrees of being parallel to one another.

A cross-section of a cathode, according to some embodiments of the present invention, is shown in FIG. 1. The cathode, which is designated by reference numeral 100, generally includes a conductive base layer 102, and an insulating layer 104 disposed on at least a portion of the base layer 102. Within the cathode 100, there is no limitation on the composition or material from which the base layer 102 is formed, with the exception that the material must be conductive. That is, the base layer 102 can be formed from a metal, semi-metal, or semiconductor (doped or undoped). Similarly, the insulating layer 104 can be formed from any insulating or dielectric material, without limitation.

The insulating layer 104 includes a plurality of apertures that project in a direction perpendicular to the surface of the base layer 102 on which the insulating layer 104 is disposed. The cathode 100 further includes a conductive gate layer 106 that is disposed on the insulating layer 104. The conductive gate layer 106 also includes a plurality of apertures that project in a direction perpendicular to the surface of the insulating layer 104 on which the gate layer 106 is disposed. Just as with the base layer 102, the conductive gate layer 106 can be formed from any conducting material, including metals, semi-metals, or semiconductors (doped or undoped).

The plurality of apertures of the insulating layer 104 and the plurality of apertures of the conductive gate layer 106 are substantially coaxial. That is, within a range of about 10 percent variation, the center of each aperture of the plurality of apertures in the insulating layer 104 is coaxial with the center of each aperture of the plurality of apertures in the gate layer 106.

The apertures of the insulating layer 104 can be different in size from the apertures of the conductive gate layer 106. In fact, the apertures can also be different in size within the individual component through which they extend. Further, a single aperture can have a non-uniform size along the length of that aperture. By way of example, as shown in FIG. 1, the apertures of the gate layer 106 are smaller than the apertures of the insulating layer 104. In addition, the apertures within the insulating layer 104 are optionally tapered such that the aperture is larger at the distal (i.e., from the base layer 102) end than at the proximal end.

In situations where an aperture in the insulating layer 104 is tapered (e.g., as shown in FIG. 1) or where an aperture in the insulating layer 104 is larger than an aperture in the gate layer 106, at least a portion of a side wall and/or a bottom surface of the distal end of the aperture of the conductive gate layer 106 is exposed such that there is direct line-of-sight between the side wall and/or bottom surface of the distal end of the aperture and a top surface of the conductive base layer 102.

There is no particular limit to the shape of the apertures of the insulating layer 104 and/or the gate layer 106. For example, an aperture can have the shape of a circle, triangle, square, rectangle, pentagon, a cross, a star, a torus or donut, any other polygon whether solid or hollow (e.g., like donut), or any other shape.

As long as the performance of the cathode 100, as will be described below, is not adversely affected by the number of, and separation between, the apertures within the insulating layer 104 and the gate layer 106, there is no particular limit to these parameters within a given cathode 100.

The cathode 100 further includes a plurality of emitters 108, which are disposed in the apertures of the insulating layer 104. Each emitter 108 comprises a plurality of vertically aligned CNTs that project toward the conductive gate layer 106. All of the emitters 108 are independently in electrical communication with the conductive base layer 102. That is, the emitters 108 can be directly or indirectly (i.e., via an intermediate layer of material) connected to the base layer 102 so as to create an electrical path between the emitters 108 and the base layer.

The CNTs that are used to make the emitters 108 of the cathode 100 can be any type of carbon nanotube, including single wall nanotubes (SWNTs), multi-wall carbon nanotubes (MWNTs), or a combination of both types of carbon nanotubes. Additional details regarding the CNTs will be provided below in describing the manufacture of the cathode 100.

There is no particular limit to the shape of the emitters 108 within the apertures of the insulating layer 104 and the gate layer 106. The emitters 108 can have the same shape as the apertures, or can have a different shape than the apertures. Thus, the plurality of vertically aligned CNTs can have the shape of a circle, triangle, square, rectangle, pentagon, a cross, a star, a torus or donut, any other polygon whether solid or hollow (e.g., like donut), or any other shape.

While the heights of the CNTs of the emitters 108 can be taller than the gate layer 106, in exemplary embodiments, the CNTs are not as tall as the top surface of the gate layer 106.

Accordingly, the overall structure of the cathode 100 is a sandwich structure in which the insulating layer 104 provides electrical insulation between the base layer 102 and the gate layer 106, and has a plurality of discrete cavities within the sandwich structure where the emitters 108 are placed.

The cathode 100 can further include an optional substrate 110 upon which the conductive base layer 102 is disposed. The substrate 110 may be useful for supporting the other components of the cathode 100 in situations where additional structural integrity is desirable. The optional substrate 110 can be formed from an insulating material or a conducting material. In cases where the substrate 110 is formed from a conducting material, one electrical lead/contact can be connected to the cathode 100 at either the substrate 110 or the base layer 102. In cases where the substrate is formed from an insulator, an electrical lead/contact must be connected to the cathode 100 at the base layer 102.

During operation of the cathode 100, an electric potential is applied to the base layer 102 (or an optional conductive substrate 110) and the gate layer 106 so as to place a bias across the gate layer 106. This bias is positive relative to the base layer 102. When the bias voltage is large enough, the local electric field at the surface of the CNTs can become high enough to emit electrons therefrom. This voltage is frequently termed the "turn-on" value or voltage. This electric-field-induced phenomenon can be used to emit electrons from the surface of the CNTs into a vacuum or into another material.

An advantage of using a plurality of vertically aligned CNTs as an emitter 108 for the cathode 100 is that high temperatures are not necessary for emission to occur. Thus, the CNT-containing cathode 100 is a so-called "cold cathode" that also exhibits the high thermal and/or mechanical durability of CNTs. In contrast, existing field effect electrodes based on thermionic emission routinely have emitter materials that can fail because of thermal and mechanical instability under the high temperatures to which they are exposed.

Another advantage of using a plurality of vertically aligned CNTs as an emitter 108 for the cathode 100 is that the electron emission does not originate from any one point, but is spread across many single nanotubes, namely those where the local electric field from the gate to the CNTs exceeds the turn-on value. Thus, in contrast to existing field effect electrodes where a single emitter material per cavity is used for field emission, an emitter 108 within the cathode 100 of the present invention does not fail simply because a single emitter material fails. That is, an emitter 108 formed from a plurality of vertically aligned CNTs can produce an evenly distributed, steady emission of electrons with a longer life-span, even if a single CNT within the plurality of CNTs fails.

Yet another advantage of using a plurality of vertically aligned CNTs as an emitter 108 for the cathode 100 is that the cathode 100 can be tailored to provide a desired current by adjusting the density of the CNTs in each emitter 108. For example, higher currents can be achieved simply by increasing the number of CNTs for each emitter 108, with only a negligible increase in mass of the cathode 100 and fabrication complexity. Similarly, lower currents can be achieved simply by reducing the number of CNTs of each emitter 108, which is accompanied by a decrease in mass of the cathode 100 and greater fabrication ease.

Alternatively, the current provided by the cathode 100 can be tailored by controlling the height of the CNTs within an emitter 108. Specifically, when all of the CNTs are of the same height in an emitter 108, the possibility of electric field screening (i.e., the presence of too many mobile charge carriers can cause a reduction in a localized electric field) can occur. Thus, for example, higher currents can be achieved simply by providing a greater variation in the relative heights of the CNTs within an emitter 108. Similarly, lower currents can be achieved simply by providing more uniformity in the relative heights of the CNTs within an emitter 108.

A process for making the cathode 100 includes first providing a substrate 110 on which the base layer 102 can be disposed. The base layer 102 can be disposed on the optional substrate 110 using any known technique for doing so. For example, the base layer 102 can be pre-fabricated, and it can be fastened (e.g., mechanically or chemically) to the substrate 110. Alternatively, the base layer 102 can be fabricated directly on the substrate 110 using any known fabrication technique. Examples of such techniques include physical vapor deposition and all of the variants thereof, chemical vapor deposition and all of the variants thereof, electroless or electrolytic plating, wet chemical methods (e.g., sol-gel, chemical surface modifications, or other like method), sputtering and all of the variants thereof, ablation deposition and all of the variants thereof, molecular beam epitaxy and all of the variants thereof, photolithography, thermal surface modifications, and the like.

If no substrate is necessary, then the first step for fabricating the cathode 100 can involve providing a base layer 102, followed by disposing the insulating layer 104 thereon. The insulating layer 104 can be disposed on the base layer 102 using any of the techniques described above. In addition to the techniques described above, the surface of the base layer 102 can be chemically modified in specific locations so as to produce the insulating layer 104.

The apertures in the insulating layer 104 can be created by removing portions of the already-fabricated insulating layer 104, or they can be created by intentionally leaving voids in specified locations during fabrication of the insulating layer 104. Removal of portions of the insulating layer 104 can be achieved, for example, by micro-machining, chemical etching, photolithographic techniques, or the like. Alternatively, the apertures in the insulating layer 104 can be created after the gate layer 106 has been disposed on the insulating layer 104.

The gate layer 106 can be disposed on the insulating layer 104 using any of the techniques described above for fabrication of the base layer 102 or the insulating layer 104.

The apertures in the gate layer 106 can be created by removing portions of the already-fabricated gate layer 106, or they can be created by intentionally leaving voids in specified locations during fabrication of the gate layer 106. Removal of portions of the gate layer 106 can be achieved using any of the techniques described above for removal of portion of the insulating layer 104.

It should be recognized that the fabrication steps described thus far can be carried our in the reverse order. For example, instead of using the base layer 102 (or the substrate 110) as the first layer, the gate layer 106 can be provide first, followed by the insulating layer 104, the base layer 102, and the optional substrate 110. In a similar manner, the apertures in the gate layer 106 and the insulating layer 104 can be created after the complete sandwich structure is fabricated; or they can be made first, followed by addition of the base layer 102 and the optional substrate 110. Such a process can be carried out using any of the techniques described above.

In general, the thickness of the insulating layer 104 is greater than that of the base layer 102 or the gate layer 106. In situations, however, where no substrate 110 is used and the base layer 102 is used to provide structural integrity to the cathode 100, the base layer 102 can be thicker than the insulating layer 104. The relative thicknesses of the base layer 102 and the gate layer 106 can vary without limitation.

After the apertures have been fabricated in both the insulating layer 104 and the gate layer 106, the pluralities of vertically aligned CNTs can be created in the apertures. Alternatively, the pluralities of vertically aligned CNTs can be created before the insulating layer 104 and the gate layer 106.

Once again, the CNTs that are used to make the emitters 108 of the cathode 100 can be any type of carbon nanotube, including SWNTs, MWNTs, or a combination of both types of carbon nanotubes. The CNTs can be made from any known means, including, but not limited to, gas-phase synthesis from high temperature, high-pressure carbon monoxide, catalytic chemical vapor deposition using carbon-containing feedstocks and/or metal catalyst particles, laser ablation, arc methods, or any other method for synthesizing carbon nanotubes on a surface.

The CNTs can also optionally include non-carbon elements in the backbone. For example, elements such as boron, nitrogen, sulfur, silicon, or the like, can be included in the backbone of the CNTs depending on the particular application for the cathode 100 formed therefrom.

The average diameter of the CNTs can be about 0.5 nanometers (nm) to about 75 nm. In some situations, it is desirable to use nanotubes having an average diameter of less than or equal to about 10 nm. The average length of the nanotubes can be greater than or equal to about 10 nm. For example, nanotubes having lengths on the order of millimeters or even centimeters could be used.

It is desirable for the CNTs to have a purity of at least 95 percent (%), and preferably at least 99%, in order to minimize the potential for adverse affects caused by impurities within the CNT sample. Thus, the CNTs can optionally be purified to remove non-nanotube carbon, such as amorphous carbon, and metallic catalyst residues.

Purification can be achieved by any known means. Procedures for purification of carbon nanotubes (while in the cavities created by the apertures of the insulating layer 104 and the gate layer 106) are well known to those skilled in the art to which this disclosure pertains. The optionally purified CNTs can also be dried. Similarly, procedures for drying CNTs (while in the cavities created by the apertures of the insulating layer 104 and the gate layer 106) are well known to those skilled in the art to which this disclosure pertains.

Depending on the particular application for the cathode 100 formed therefrom, the CNTs can be optionally derivatized on their ends and/or sides with a functional group. These functional groups can include an alkyl; acyl; aryl; aralkyl; halogen; substituted or unsubstituted thiol; substituted or unsubstituted amino; hydroxyl; an OR' wherein R' can include an alkyl, acyl, aryl, aralkyl, substituted or unsubstituted amino, substituted or unsubstituted thiol, and halogen; or a linear or cyclic carbon chain optionally interrupted with one or more heteroatom, and optionally substituted with one or more =O, or =S, hydroxyl, aminoalkyl group, amino acid, or a peptide. The extent of the substitution can be tailored to achieve the desired electronic effect, as would be understood to those skilled in the art to which this disclosure pertains. By way of one example, the number of carbon atoms in the alkyl, acyl, aryl, aralkyl groups can be in the range of 1 to about 30.

Also depending on the particular application for the cathode 100, the CNTs can be optionally treated (e.g., with an acid or other chemical) so as to alter their lengths.

After the CNTs have been disposed in the apertures of the insulating layer 104 and the gate layer 106, the electrode 100 is complete.

By way of example, one process for preparing a cathode 100 involves first providing a wafer of n-type silicon as the base layer 102. In general, n-type doping provides a greater number of electron donors for emission. A layer of photoresist is spun on the backside of the base layer wafer 102 to prevent oxide growth, thereby providing a location for an electrical connection to the cathode 100. A thin film of $SiO_2$, which serves as the insulating layer 104, is thermally grown on the top side of the base layer wafer 102. A thin layer of chromium (Cr), which acts as the gate layer 106, is subsequently deposited on the insulating layer 104 by electron beam evaporation.

The top gate layer 106 is then patterned with a photoresist using photolithography. The pattern corresponds to the locations of the pluralities of CNTs to be grown. After the pattern is developed, the Cr gate layer 106 is etched away in the shape corresponding to the pattern via a standard chromium etch process. After etching the Cr gate layer 106, the insulating $SiO_2$ layer 104 is etched via reactive ion etching. Etching the two materials involves isotropic processes, and the insulator layer 104 is much thicker than the gate layer 106. Thus, care must be taken to ensure that the insulator etch does not completely remove the entire gate layer 106. This can be a significant problem if the proper insulator layer 104 and gate layer 106 materials are not chosen. In addition to etch problems, the materials chosen for the insulator layer 104 and gate layer 106 should not inhibit CNT nucleation or growth.

Once etched, the apertures allow for a line-of-sight deposition path for the deposition of an iron (Fe) catalyst layer directly on the on the n-type silicon base layer 102. This will ensure that an ohmic connection exists between the emitters 108 and the base layer 102. The photo-resist and excess Fe is removed via a stand liftoff process making use of sonication in acetone. The CNTs are grown using catalyze pyrolytic decomposition of hydrocarbon gases in a chemical vapor deposition chamber. In this case, the cathode 100 includes Fe catalyst particles between the pluralities of vertically aligned CNTs and the base layer 102.

Figure 2:
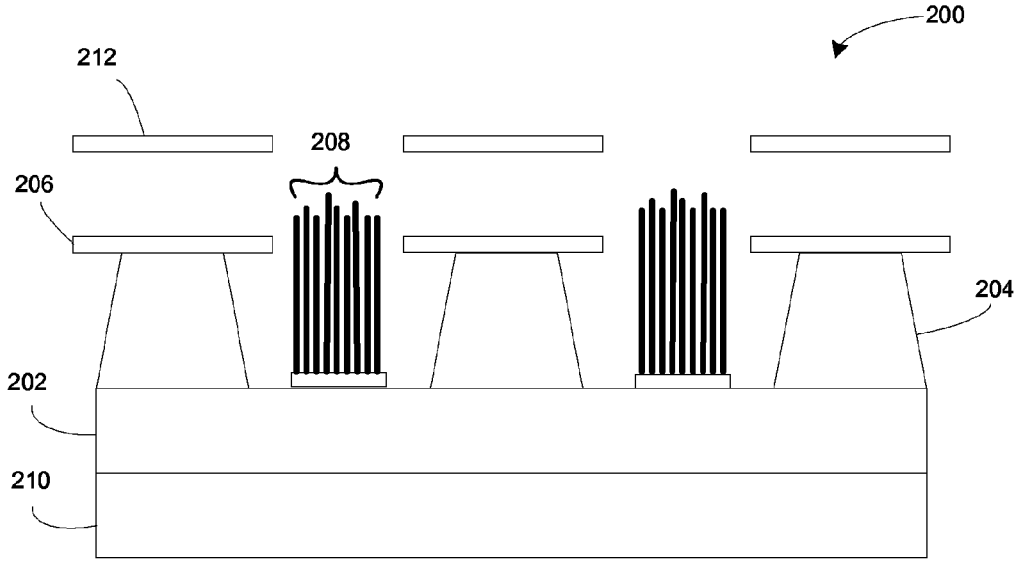
FIG. 2 is a schematic illustration of a carbon nanotube-containing cold cathode in accordance with other embodiments of the present invention.

Another improved cathode, according to some embodiments of the present invention, is shown in FIG. 2 and is generally designated by reference numeral 200. The cathode comprises a base layer 202, insulating layer 204, gate layer 206 and optional substrate 210 exactly as described above for the cathode 100 of FIG. 1. Emitters 208 are identical to emitters 108 of the cathode 100 of FIG. 1, with the exception that the CNTs of emitters 208 are taller than the top surface of gate layer 206. To compensate for the increased height of the CNTs of the emitters 208, cathode 200 further includes an extrinsic gate layer 212. Extrinsic gate layer 212 has a bottom surface that is taller than the CNTs of emitters 208.

The use of CNTs that extend beyond the gate layer 206 can result in a cathode 200 that has a longer operational lifetime. For example, during operation of cathode 200, the emitters 208 can be exposed to conditions that deteriorate the CNTs. Thus, because the CNTs are longer, they can be exposed to deteriorating conditions for longer periods of time before they fail. Further, in some cases, if the CNTs deteriorate to the extent that they no longer extend beyond the gate layer 206, then extrinsic gate layer 212 can be removed, thereby allowing cathode 200 to effectively function identically to cathode 100.

The configuration of cathode 200 occupies more space than that of the cathode 100 shown in FIG. 1. Thus, in situations where size is less relevant, such a cathode 200 would be beneficial to use.

The cathode 200 of FIG. 2 can be fabricated exactly as described for the cathode 100 of FIG. 1, with the exception that the CNTs of the emitters 208 are grown to a length that renders the CNTs taller than the top surface of gate layer 206. Extrinsic gate 212 can be provided separately at a particular distance from the other components of cathode 200, or it can be held fixed (e.g., by spacers or other structural components) in place at a specific height above the CNTs of emitters 208. The extrinsic gate layer 212 can positioned at any height above the CNTs of the emitters 208 that will still allow electrons to be emitted from the emitters 208. This height can be as low as a tens of micrometers to has high as several millimeters.

Figure 3:
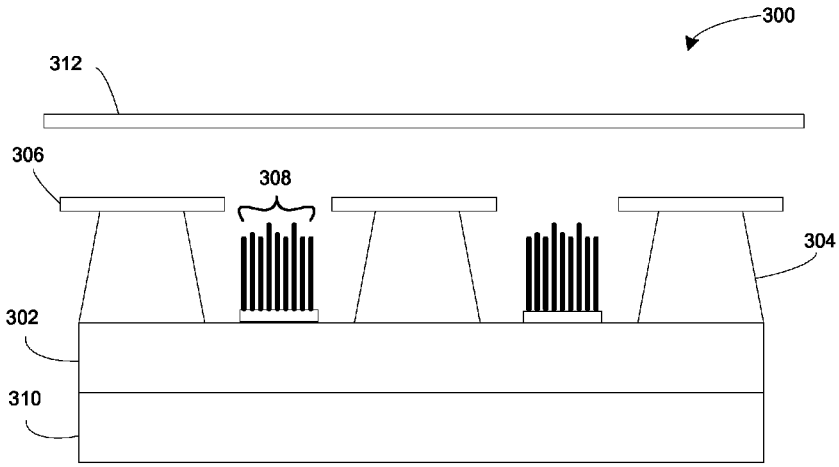
FIG. 3 is a schematic illustration of a carbon nanotube-containing cold cathode in accordance with still other embodiments of the present invention.

Another improved cathode, according to some embodiments of the present invention, is shown in FIG. 3 and is generally designated by reference numeral 300. The cathode comprises a base layer 302, insulating layer 304, gate layer 306, emitters 308, and optional substrate 310 exactly as described above for the cathode 100 of FIG. 1. Cathode 300 further includes a dynode layer or electron multiplier layer 312 so as to provide cathode 300 with a secondary field emission effect (comparable to a photomultiplier effect). Cathode 300 is not limited to one dynode layer 312, but for illustrative convenience only one dynode layer 312 is shown. The dynode layer 312 can be formed from magnesium oxide (MgO), lead oxide (PbO), alumina ($Al_2O_3$), cesium iodide (CsI), diamond, calcium fluoride (CaF), aluminum nitride (AlN), boron nitride (BN), beryllium oxide (BeO), or like composition.

During operation of electrode 300, electrons are emitted from the surface of the CNTs of the emitters 308 as described above for the cathode 100 of FIG. 1. The electrons emitted from the emitters 308 are accelerated toward the dynode layer 312, which is maintained at a positive bias voltage with respect to the gate layer 306. Each accelerated electron that strikes the dynode layer 312 can produce several electrons, that are then emitted from the dynode layer 312. If additional dynode layers are used, then the electrons emitted from dynode layer 312 would be accelerated to an additional dynode layer, which itself is maintained at a positive bias voltage with respect to the dynode layer 312. Each accelerated electron that strikes the additional dynode layer can produce several electrons, which are subsequently emitted from the additional dynode layer. As additional dynode layers are used, an exponentially greater number of electrons can be produced. Thus, the use of a dynode layer 312 can provide significantly increased current production from cathode 300.

The cathode 300 of FIG. 3 can be fabricated exactly as described for the cathode 100 of FIG. 1. Dynode layer 312 can be provided separately at a particular distance from the other components of cathode 300, or it can be fixedly connected (to the other components of cathode 300) at a specific height above the gate layer 306.

The cathodes 100, 200 and 300 disclosed herein are capable of exhibiting high emission current densities. For example, emission current densities greater than about 50 milliAmperes per square centimeter ($mA/cm^2$) have readily been achieved. In addition, improved operations lifetimes can also be observed. Specifically, operational lifetimes greater than about 1500 hours have been achieved when the cathodes 100, 200 and 300 disclosed herein were implemented in low-power ion thrusters.

An ion thruster can be manufactured with the improved cathodes 100, 200 or 300 described herein. Specifically, they can be used in a Hall or Hall effect thruster, electrostatic ion thruster, field emission electric propulsion (FEEP) thruster, and/or a colloid thruster. No gas flow is required to operate the improved cathodes 100, 200 or 300 described herein. Further, no heater is required to operate the improved cathodes 100, 200 or 300 described herein. As a result, this simplicity reduces extraneous loads on the ion thrusters and allows for greater design flexibility.

By way of clarification, the improved cathodes described herein can be used as the cathode and/or the reaction mass neutralizer in a Hall effect thruster. Either a single improved cathode described herein can be used to serve both purposes; or two separate improved cathodes described herein can be used to independently serve as the cathode and reaction mass neutralizer. Similarly, the improved cathodes described herein can be used as the cathode and/or the reaction mass neutralizer in an electrostatic ion thruster. In this case two separate improved cathodes described herein must be used to serve these functions. Finally, if the improved cathodes described herein are to be used in a colloid thruster or a FEEP thruster, the can only serve as a reaction mass neutralizer.

The various ion thruster engines described above are well known to those skilled in the art to which this disclosure pertains. Accordingly, a detailed description of the structure of each ion thruster is not provided herein.

The various embodiments of the present invention are further illustrated by the following non-limiting examples.

EXAMPLES

Example 1

Fabrication of a CNT-Containing Cold Cathode

A wafer of n-type silicon was used the base layer. A thermally grown layer of $SiO_2$ was prepared as the insulating layer, followed by a thin layer of Cr deposited by electron beam evaporation to act as the gate layer.

The top of the wafer was then provided with a repeating photoresist pattern, corresponding to the shape of the CNT emitters, using photolithography. After the pattern was developed, the Cr gate was etched away in the shape of the CNT emitters via a standard chromium etch process. After etching the Cr gate, the insulating $SiO_2$ was etched via reactive ion etching.

The etched Cr and $SiO_2$ provided a line-of-sight deposition path for deposition of an iron catalyst layer directly on the silicon wafer, ensuring an ohmic connection between the CNT emitters and the base. The photoresist and excess Fe was removed via a liftoff process using sonication in acetone. The CNTs were grown using chemical vapor deposition in a quartz furnace with methane, acetylene, and hydrogen.

Figure 4A:
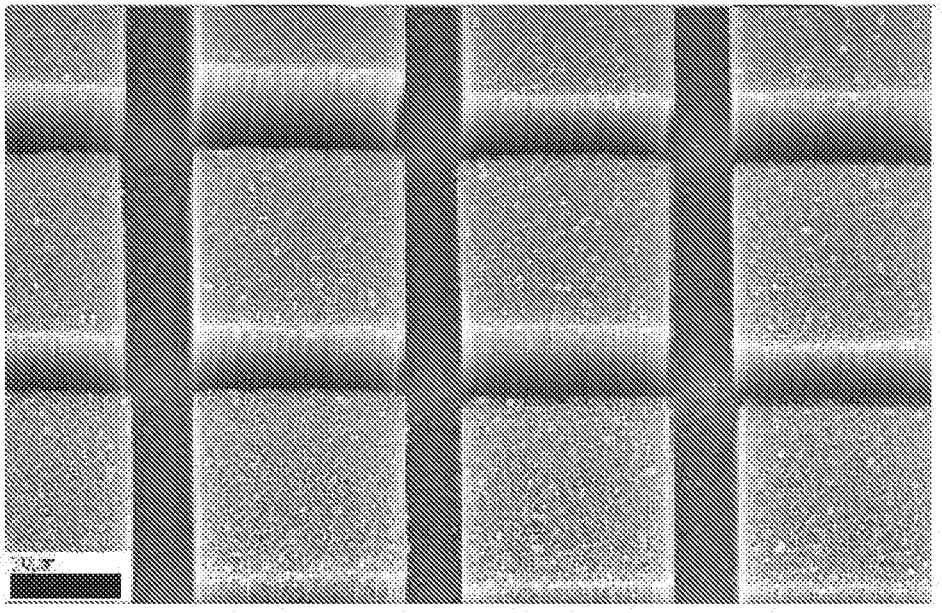
FIG. 4 includes a scanning electron microscope image of (a) a plurality of carbon nanotube emitters and (b) the morphology of the carbon nanotubes within an emitter in accordance with Example 1.
Figure 4B:
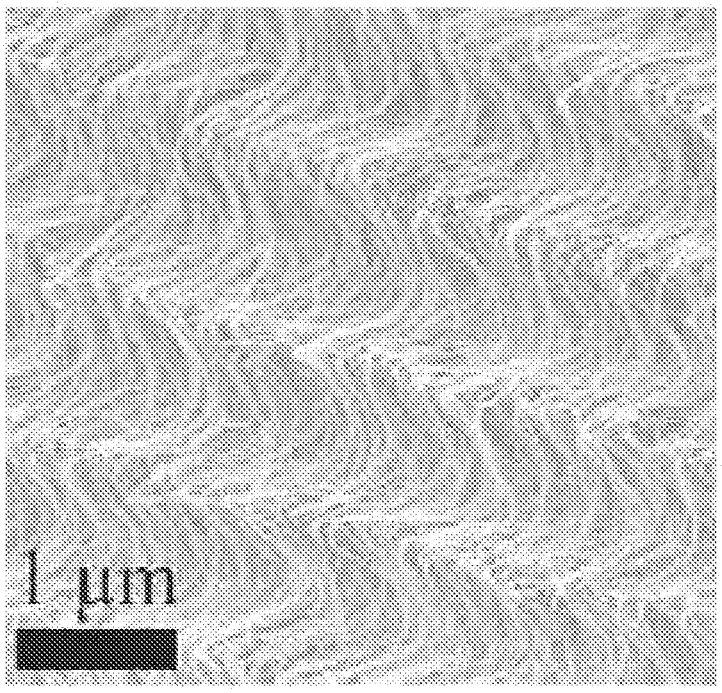

FIG. 4(*a*) provides a scanning electron microscope (SEM) image of the CNT emitters. As seen in the SEM image, the CNT emitters were square-shaped. The arrays had a height variation of about 2% within the same emitter, and each emitter had only about a 5% variation in height in comparison to other emitters. The CNT morphology can be seen in the SEM image of FIG. 4(*b*). The CNTs were multi-wall carbon nanotubes that had an outer diameter of about 10 nanometers to about 19 nanometers. Despite the overall structure in the CNT emitters, the individual CNTs displayed a kinked vine-like morphology.

Additional cathodes were created having a variety of patterns for the emitters. These patterns, created from the photolithography, generally included a repeated two-dimensional shape with a given pitch, or separation distance, between the centers of each shape. The patterns of the samples tested are outlined in Table 1.

TABLE 1

CNT Emitter Patterns.

| Pattern Shape | Pattern Size (μm) | Pitch (μm) | CNT Area ($cm^2$) |
|---|---|---|---|
| Ring | 4 | 32 | 0.0072 |
| Triangle | 4 | 16 | 0.017 |
| Diamond | 8 | 64 | 0.012 |
| Square | 4 | 16 | 0.040 |
| Star | 8 | 32 | 0.015 |
| Ring | 8 | 64 | 0.0085 |
| Circle | 8 | 32 | 0.031 |
| Ring | 2 | 16 | 0.0086 |

Figure 5A:
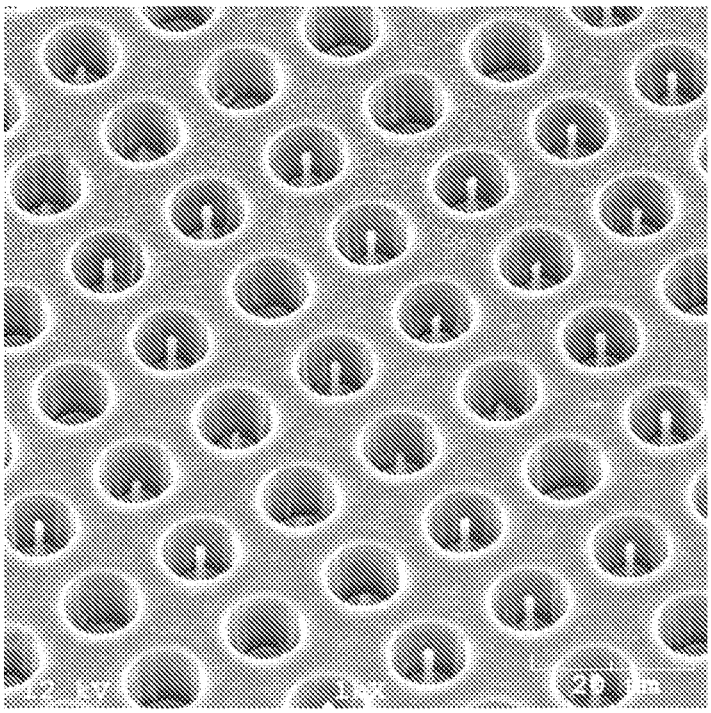
FIG. 5 includes a scanning electron microscope image of (a) the top surface of a cathode having a plurality of carbon nanotube emitters and (b) an inset of a single emitter containing a plurality of carbon nanotubes in accordance with Example 1.
Figure 5B:
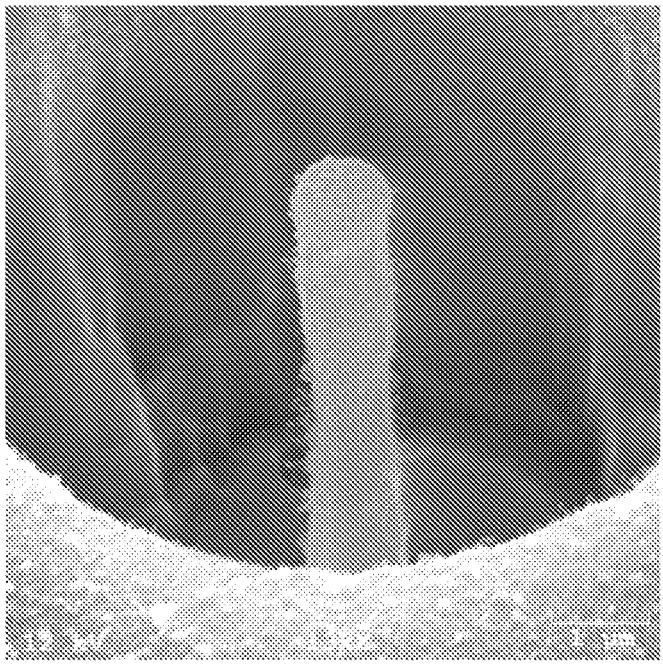

FIG. 5(*a*) provides a SEM image of the top surface of a cathode with a plurality of circular shaped apertures in the gate and insulating layers. As seen in the SEM image, the CNT emitters had a circular cross-section, thereby producing a cylindrical shape emitter. A magnified image of a single emitter can be seen in the SEM image of FIG. 5(*b*).

Example 2

Fabrication and Characterization of Cold Cathodes Having Overgrown CNTs

Figure 6:
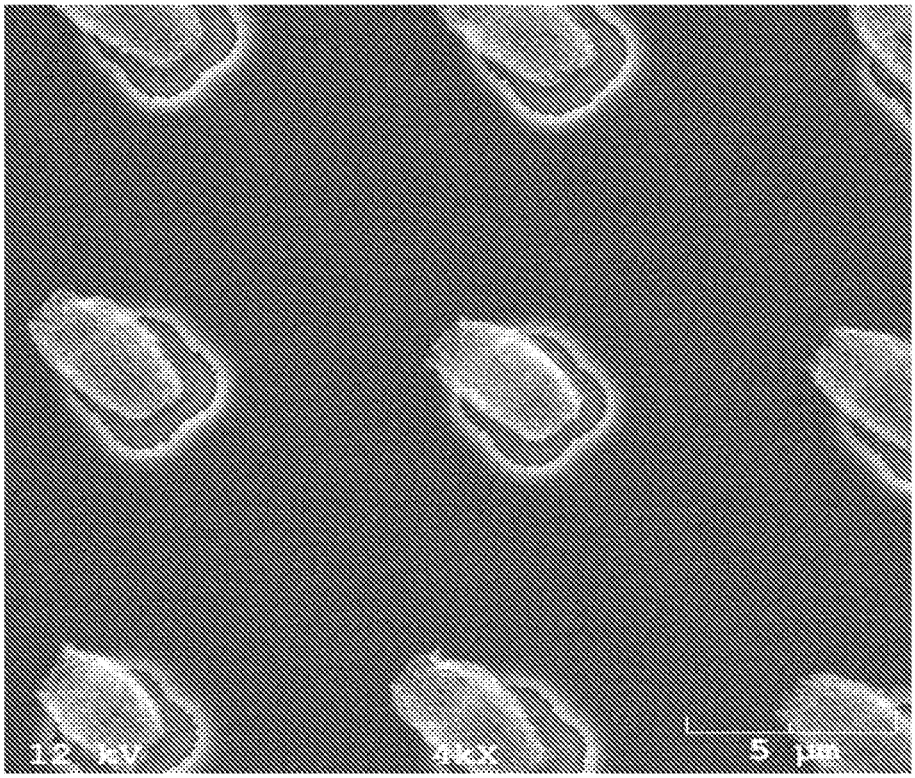
FIG. 6 includes a scanning electron microscope image of a plurality of plus-shaped overgrown carbon nanotube emitters in accordance with Example 2.

The process described in EXAMPLE 1 was used to produce cathodes having overgrown CNTs (i.e., CNTs that extend beyond the gate layer). The SEM image of FIG. 6 illustrates an example of such overgrowth in the form of "plus"-shaped emitters.

An extrinsic gate, which was set about 1.3 millimeters from the surface of the original gate. The extrinsic gate was formed from molybdenum (Mo). To characterize these cathodes, the cathode having the extrinsic gate was paired with an anode to form a triode structure.

The turn-on electric field was measured for eight cathodes configured in this fashion. The turn on voltage was defined as the voltage where the cathode emission exceeded 1 milliAmpere. Between the samples, a turn-on electric field of about 0.22 Volts per millimeter to about 0.67 Volts per millimeter was observed.

Similarly, the current densities were measured for eight cathodes configured in this fashion. At electric fields less than about 1.54 Volts per millimeter, current densities as high as about 54.6 milliAmperes per square centimeter were observed.

The above data are not intended to be limiting, but instead provide illustrative examples of cathodes fabricated according to some embodiments of the present invention.

The embodiments of the present invention are not limited to the particular formulations, process steps, and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of this disclosure have been described in detail with particular reference to exemplary embodiments, those skilled in the art will understand that variations and modifications can be effected within the scope of the disclosure as defined in the appended claims. Accordingly, the scope of the various embodiments of the present invention should not be limited to the above-discussed embodiments, and should only be defined by the following claims and all equivalents.

All patents and other references cited herein are incorporated by reference as if fully set forth herein.

What is claimed is:

1. A cathode, comprising:

a conductive base layer;

an insulating layer disposed on the conductive base layer and having a plurality of apertures therein;

a conductive gate layer disposed on the insulating layer and having a plurality of apertures therein, wherein the plurality of apertures of the insulating layer and the plurality of apertures of the conductive gate layer are substantially coaxial, and wherein at least a portion of a side wall and/or a bottom surface of a distal end of each aperture of the plurality of apertures of the conductive gate layer is vertically exposed to a surface of the conductive base layer;

a plurality of emitters in electrical communication with the conductive base layer, wherein each emitter of the plurality of emitters is disposed in an aperture of the insulating layer and projects toward the conductive gate layer, wherein each emitter of the plurality of emitters comprises an array of vertically aligned carbon nanotubes, and wherein a length of the carbon nanotubes is greater than a distance between the conductive base layer and the conductive gate layer such that the carbon nanotubes extend beyond the conductive gate layer; and wherein each aperture of the plurality of apertures of the insulating layer are tapered, wherein the aperture is larger at an end distal from the conductive base layer than at an end proximal to the conductive base layer.

2. The cathode of claim 1, further comprising a substrate on which the conductive base layer is disposed for additional structural integrity of the cathode.

3. The cathode of claim 1, wherein the vertically aligned carbon nanotubes of each emitter of the plurality of emitters are disposed on a catalyst layer that is disposed on the conductive base layer.

4. The cathode of claim 1, wherein the emitters do not have a same shape as the apertures of the insulating layer.

5. The cathode of claim 1, further comprising an extrinsic gate layer disposed above, and not in contact with, the gate layer.

6. The cathode of claim 1, further comprising a dynode layer disposed above, and not in contact with, the gate layer.

7. The cathode of claim 1, wherein the cathode exhibits a current density greater than about 50 milliAmperes per square centimeter.

8. An ion thruster, comprising:

an electrode, comprising:

a conductive base layer;

an insulating layer disposed on the conductive base layer and having a plurality of apertures therein;

a conductive gate layer disposed on the insulating layer and having a plurality of apertures therein, wherein the plurality of apertures of the insulating layer and the plurality of apertures of the conductive gate layer are substantially coaxial, and wherein at least a portion of a side wall and/or a bottom surface of a distal end of each aperture of the plurality of apertures of the conductive gate layer is vertically exposed to a surface of the conductive base layer; and a plurality of emitters in electrical communication with the conductive base layer, wherein each emitter of the plurality of emitters is disposed in an aperture of the insulating layer and projects toward the conductive gate layer, wherein each emitter of the plurality of emitters comprises an array of vertically aligned carbon nanotubes, and wherein a length of the carbon nanotubes is greater than a distance between the conductive base layer and the conductive gate layer such that the carbon nanotubes extend beyond the gate layer; and wherein each aperture of the plurality of apertures of the insulating layer are tapered, wherein the aperture is larger at an end distal from the conductive base layer than at an end proximal to the conductive base layer.

9. The ion thruster of claim 8, wherein the ion thruster is a Hall effect thruster.

10. The ion thruster of claim 9, wherein the electrode is a cathode of the Hall effect thruster.

11. The ion thruster of claim 9, wherein the electrode is a reaction mass neutralizer of the Hall effect thruster.

12. The ion thruster of claim 9, wherein the electrode is a cathode and a reaction mass neutralizer of the Hall effect thruster.

13. The ion thruster of claim 8, wherein the ion thruster is an electrostatic ion thruster.

14. The ion thruster of claim 13, wherein the electrode is a cathode of the electrostatic ion thruster.

15. The ion thruster of claim 8, wherein the electrode is a reaction mass neutralizer of the electrostatic ion thruster.

16. The ion thruster of claim 8, wherein the ion thruster is a colloid thruster.

17. The ion thruster of claim 16, wherein the electrode is a reaction mass neutralizer of the colloid thruster.

18. The ion thruster of claim 8, wherein the ion thruster is a field emission electric propulsion thruster.

19. The ion thruster of claim 18, wherein the electrode is a reaction mass neutralizer of the field emission electric propulsion thruster.

* * * * *